US007817952B2

(12) United States Patent
Seo et al.

(10) Patent No.: US 7,817,952 B2
(45) Date of Patent: Oct. 19, 2010

(54) FIXER AND IMAGE FORMING APPARATUS INCLUDING THE SAME

(75) Inventors: Hiroshi Seo, Tokyo (JP); Akiko Ito, Tokyo (JP); Tadashi Ogawa, Tokyo (JP); Toshiaki Higaya, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 810 days.

(21) Appl. No.: 11/685,504

(22) Filed: Mar. 13, 2007

(65) Prior Publication Data

US 2007/0212089 A1 Sep. 13, 2007

(30) Foreign Application Priority Data

Mar. 13, 2006 (JP) ..... 2006-067386
Oct. 18, 2006 (JP) ..... 2006-283310

(51) Int. Cl.
*G03G 15/20* (2006.01)

(52) U.S. Cl. ..... 399/328; 399/320; 399/330; 399/331

(58) Field of Classification Search ..... 399/313, 399/320, 328, 329, 330, 331; 219/216, 469, 219/470, 471
See application file for complete search history.

(56) References Cited

U.S. PATENT DOCUMENTS 4,942,434 A 7/1990 Nakai et al.
5,355,204 A 10/1994 Aoki
2002/0028098 A1 * 3/2002 Kamei et al. ..... 399/313
2005/0185994 A1 8/2005 Inada et al.
2006/0013623 A1 * 1/2006 Kagawa et al. ..... 399/328

FOREIGN PATENT DOCUMENTS

| | | |
|---|---|---|
| EP | 1 569 047 A2 | 8/2005 |
| JP | 08-016007 | 1/1996 |
| JP | 09-080971 | 3/1997 |
| JP | 09-218601 | 8/1997 |
| JP | 2003-017221 | 1/2003 |
| JP | 2004-205838 | 7/2004 |
| JP | 2005-037858 | 2/2005 |
| JP | 2005-043476 | 2/2005 |
| JP | 2005-189404 | 7/2005 |
| JP | 2005-202272 | 7/2005 |
| JP | 2005-208474 | 8/2005 |
| JP | 2005-241891 | 9/2005 |
| JP | 2005-250298 | 9/2005 |
| JP | 2005-345989 | 12/2005 |

* cited by examiner

*Primary Examiner*—David P Porta
*Assistant Examiner*—Faye Boosalis
(74) *Attorney, Agent, or Firm*—Oblon, Spivak, McClelland, Maier & Neustadt, L.L.P.

(57) ABSTRACT

A fixer configured to fix an image on an recording medium passing through a fixing nip includes a holder including an elastic layer, a fixing rotator including a heating layer, provided overlying the holder, and a pressurizer configured to pressurize the holder via the fixing rotator to form the fixing nip. A part of the pressurizer, which forms the fixing nip, has a length not less than a length of the heating layer in a width direction perpendicular to a conveyance direction of the recording medium.

21 Claims, 9 Drawing Sheets

FIXER AND IMAGE FORMING APPARATUS INCLUDING THE SAME

BACKGROUND OF THE INVENTION

1. Field of the Invention

The present invention relates to a fixer and an image forming apparatus including the fixer, and more particularly to a fixer and an electronographic image forming apparatus including the fixer.

2. Discussion of the Background

In general, an electronographic image forming apparatus such as a copying machine, a printer, and a facsimile machine may include an image forming mechanism for forming an image, e.g., a toner image, on a recording medium such as a sheet or an OHP film, and a fixer to fix the toner image on the recording medium.

An example of a fixer includes a fixing member, a heat source to heat the fixing member, and a pressurizer. The pressurizer is pressed to the fixing member to form a fixing nip therebetween. When the recording medium passes through the fixing nip, the toner image is fused and fixed with heat from the fixing member and pressure from the pressurizer onto the recording medium. The fixing member may be a roller in which a heat source is provided. Alternatively, the fixing member may be a belt wound around a roller having a heat source therein. As a heat source, heat from a halogen heater provided near the heating member may be used.

The heat source of the above fixer may be turned off during waiting time to save energy. When an image formation is started, the heat source is turned on and the fixing member is heated to a fixing temperature during warm-up time (startup time). To keep power consumption low to save energy, the fixing member desirably has a lower heat capacity.

A fixer employs an induction heating method to shorten the warm-up time and to save energy. For example, an induction heating fixer 101 includes a fixing roller 3, a pressing roller 4, and an induction coil 5 as illustrated in FIG. 1. The fixing roller 3 includes a support shaft 1 in its center and a fixing rotator 2 wound around the support shaft 1. The pressing roller 4 includes a core metal 6 and a rubber layer 7 around the core metal 6. The pressing roller 4 is pressed against the fixing roller 3 and a nip n is formed between the two rollers. The induction coil 5 is provided around the fixing roller 3 in a non-contact manner.

FIG. 2 illustrates edges of the fixing roller 3 and the pressing roller 4 in their width direction (axis direction). The support shaft 1 includes a core metal 1*a* and an elastic insulating layer 1*b* wound on the core metal 1*a*. With the elastic insulating layer 1*b*, the nip n may have a sufficient width for fixing. The fixing rotator 2 includes an induction heating layer 2*a*, an elastic layer 2*b*, and a release layer 2*c* from inside.

When electric current is applied to the induction coil 5 (shown in FIG. 1), a magnetic field of high-frequency waves is induced. Induction current occurs at a side near the induction coil 5 in the induction heating layer 2*a*. An outer surface of the fixing roller 3 is heated with joule heating.

An optimum input power was determined by adjusting an eddy-current load on the fixing rotator 2. The graph of FIG. 3 shows a relation between heating value and eddy-current load at a frequency of 30 kHz. The eddy-current load specifies heating characteristics of a heating layer by induction heating and may be expressed in the following formula:

$$d=vr/t$$

wherein d is the eddy-current load, vr is a volume resistivity of the heating layer, and t is a thickness of the heating layer.

However, magnetic flux may penetrate only to a depth less than an epidermis depth δ, when the thickness of the heating layer is larger than the epidermis depth δ. In that case, the eddy-current load may be expressed in the following formula:

$$d=vr/\delta$$

When k is a constant, ρ is a resistivity, μ is a relative permeability, and f is a frequency, the epidermis depth δ may be expressed in the following formula:

$$\delta=k\,(\rho/f\mu)^{1/2}$$

Based on the above, a thickness of the induction heating layer 2*a* at which the eddy-current load was optimum was checked by inductively heating the induction heating layer 2*a* that includes a material whose resistivity is lower at a frequency of around 30 kHz. The thickness of the induction heating layer 2*a* was less than a few dozen micron meters which was remarkably thinner than a thickness of a thin sleeve of a halogen heater that was a few hundred micron meters.

However, when the induction heating layer 2*a* is thinner, the fixing rotator 2 consequently becomes thinner. The geometrical moment of inertia is in proportion to a third power of the thickness. Therefore, mechanical strength (flexural rigidity) is decreased when the fixing rotator 2 becomes thinner. The flexural rigidity is expressed in the following formula:

$$\text{Flexural rigidity}=E\times I$$

wherein E is modulus of direct elasticity and I is the geometrical moment of inertia.

When the pressing roller 4 is pressed to the fixing roller 3 as illustrated in FIG. 1, the elastic insulating layer 1*b* in the support shaft 1 is elastically deformed. Due to elastic repulsion of the elastic insulating layer 1*b*, both edges e of the fixing roller 3 in its width direction shown as arrow T are likely to curve as illustrated by a two-dot chain line in FIG. 2. Further, a shearing force occurs in the sleeve-shaped fixing rotator 2, which may damage the fixing rotator 2.

To prevent such damage, it is necessary to increase the thickness of the fixing rotator 2. However, when the fixing rotator 2 is thicker, flexibility of the fixing rotator is decreased. Consequently, it may be difficult to form enough of a fixing nip n.

SUMMARY OF THE INVENTION

In view of foregoing, in one exemplary embodiment, a fixer configured to fix an image on an recording medium passing through a fixing nip includes a holder including an elastic layer, a fixing rotator including a heating layer, provided overlying the holder, and a pressurizer configured to pressurize the holder via the fixing rotator to form the fixing nip. A part of the pressurizer which forms the fixing nip has a length not less than a length of the heating layer in a width direction perpendicular to a conveyance direction of the recording medium.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EMBODIMENTS OF THE INVENTION

Figure 1:
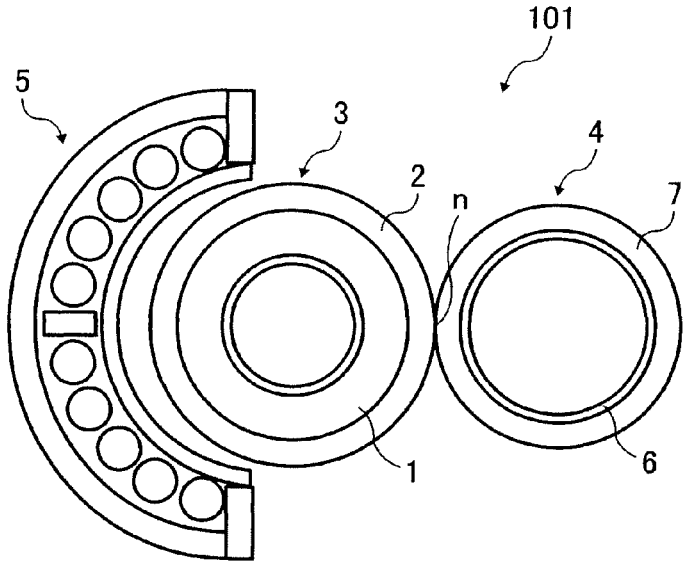
FIG. 1 RELATED ART
FIG. 1 is an illustration of a related-art fixer employing an induction heating method.
Figure 2:
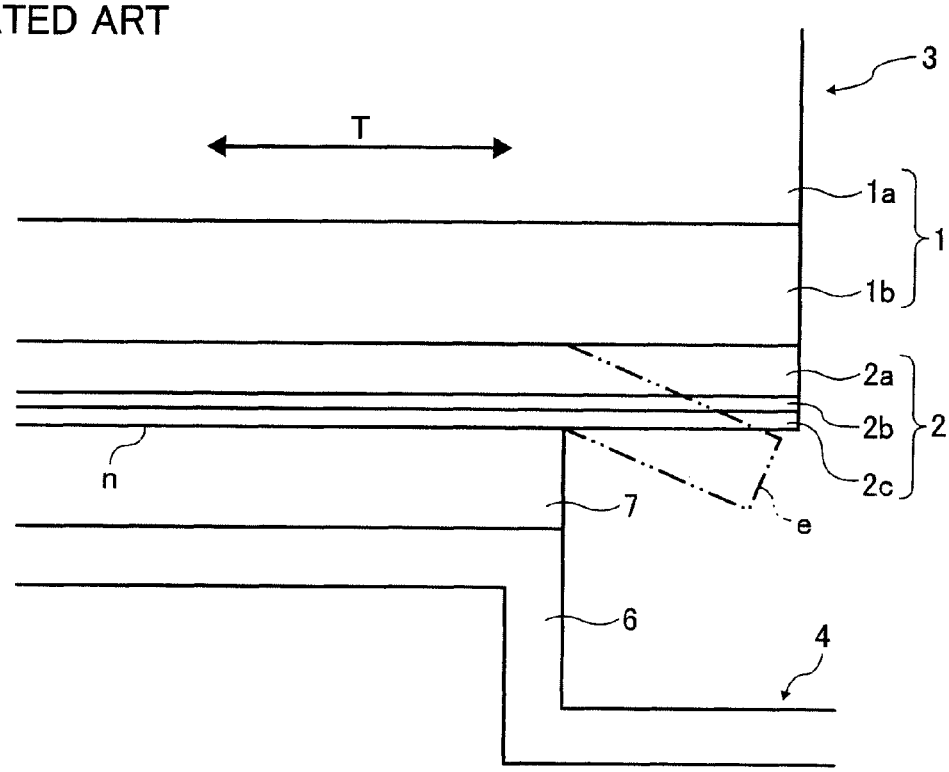
FIG. 2 RELATED ART
FIG. 2 is an illustration of edges of a fixing roller and a pressing roller in the fixer of FIG. 1.
Figure 3:
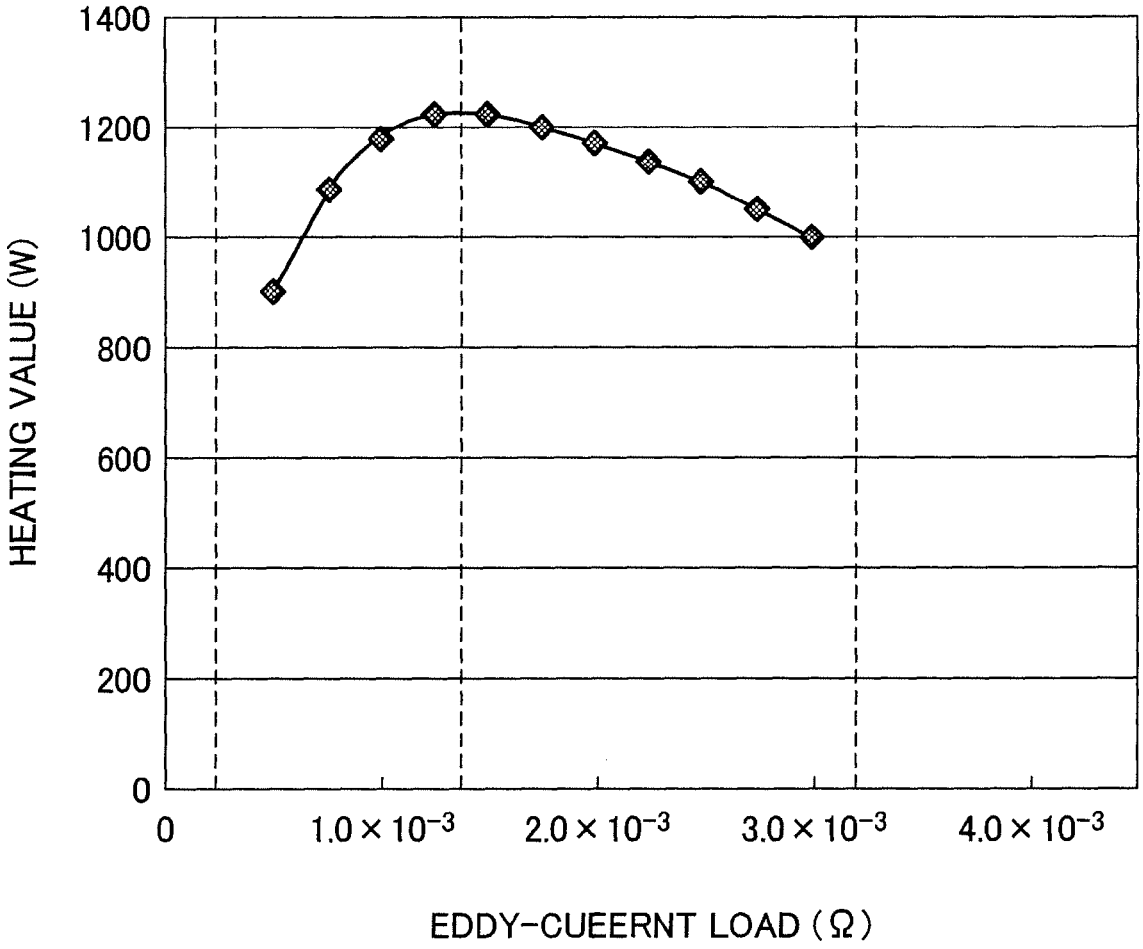
FIG. 3 RELATED ART
FIG. 3 is a graph showing a relation between eddy-current load and heating value.

In describing the exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Figure 4:
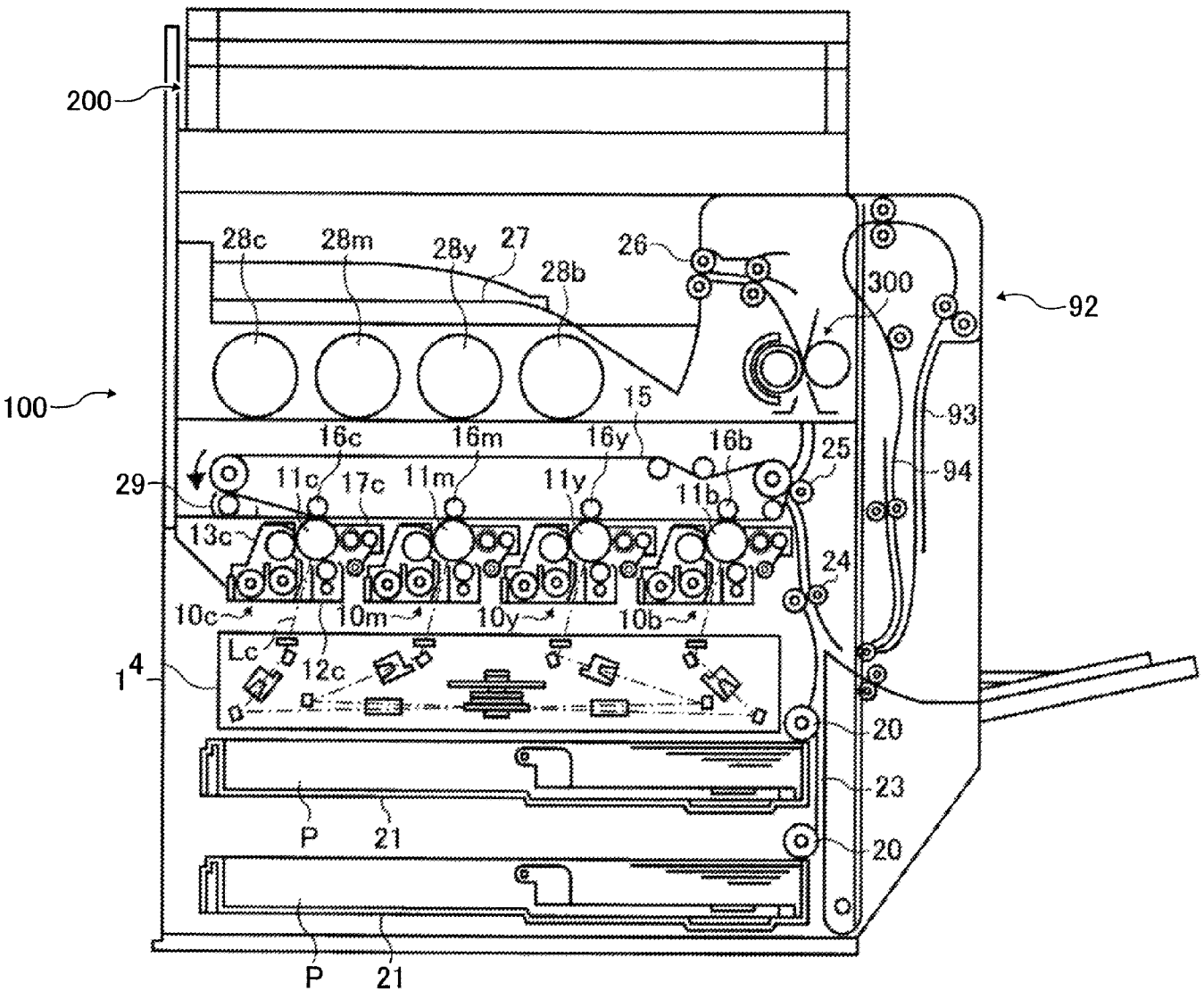
FIG. 4 is a schematic view illustrating a cross-section of an exemplary embodiment of an image forming apparatus.

Referring now to the drawings, wherein like reference numerals designate identical or corresponding parts throughout the several views, particularly to FIG. 4, an image forming apparatus 100 according to an exemplary embodiment of the present invention is described.

FIG. 4 schematically illustrates an internal mechanism of the image forming apparatus 100 that may be a copier, a printer, a scanner, a facsimile machine, or a multi-function machine. A reading device 200 is provided over the top of the image forming apparatus 100.

The image forming apparatus 100 may be a tandem color printer including four image forming stations 10*c*, 10*m*, 10*y*, and 10*b* that are image forming mechanisms. Each of the image forming stations 10*c*, 10*m*, 10*y*, and 10*b* forms a cyan image, a magenta image, a yellow image, or a black image and includes one of the photoreceptors 11*c*, 11*m*, 11*y*, and 11*b*. The image forming apparatus 100 may further include a writing device 14, an intermediate transfer member 15, and primary transferers 16*c*, 16*m*, 16*y*, and 16*b*. Each of the primary transferees 16*c*, 16*m*, 16*y*, and 16*b* may be provided at a position facing one of the photoreceptors 11*c*, 11*m*, 11*y*, and 11*b* across the intermediate transfer member 15. The image forming apparatus 100 may further include a plurality of feeding rollers 20, a plurality of sheet cassettes 21, a sheet conveyance path 23, a pair of registration rollers 24, a secondary transferer 25, a pair of ejection rollers 26, and a stacker 27. The image forming apparatus 100 may further include toner bottles 28*c*, 28*m*, 28*y*, and 28*b*, a secondary cleaning device 29, a fixer 300, a double-side printing unit 92, a switchback path 93, and a return path 94.

As the image forming stations 10*c*, 10*m*, 10*y*, and 10*b* have a similar configuration and a similar function, except they handle different colors of images to be formed, the configuration and function thereof are described based on the image forming station 10*c*.

The photoreceptor 11*c* is drum shaped and may rotate clockwise in FIG. 4. The image forming station 10*c* may further include a charger 12*c* and an image developer 13*c*. The charger 12*c* applies bias voltage to the photoreceptor 11*c* to uniformly charge a surface thereof along with the rotation of the photoreceptor 11*c*.

The reading device 200 may read image information from an original document and transmit the image information as a signal to the image forming apparatus 100. When the image forming apparatus 100 is a printer, an image signal from a host may be received. When the image forming apparatus 100 is a facsimile machine, a signal transmitted via telephone lines may be received. The writing device 14 is an irradiator that applies a laser light Lc based on the received signal to form an electrostatic latent image on the photoreceptor 11*c*. The image developer 13*c* may develop the electrostatic latent image with a cyan toner into a visible cyan image. Similarly, magenta, yellow, and black images are formed on the photoreceptors 11*m*, 11*y*, and 11*k* in the image forming stations 10*m*, 10*y*, and 10*b*.

The intermediate transfer member 15 may be an endless belt and may rotate counterclockwise in FIG. 4 while being in contact with the photoreceptors 11*c*, 11*m*, 11*y*, and 11*b*. The primary transferers 16*c*, 16*m*, 16*y*, and 16*b* may transfer the toner images on the photoreceptors 11*c*, 11*m*, 11*y*, and 11*b* in order from the cyan image onto the intermediate transfer member 15 as a primary transfer. The primary transferees 16*c*, 16*m*, 16*y*, and 16*b* may superimpose the toner images one another and form a full color image on the intermediate transfer member 15. After the primary transfer, the primary cleaning device 17*c* may clean and initialize the photoreceptor 11*c*. Each of the photoreceptor 11*m*, 11*y*, and 11*b* is similarly cleaned and initialized by a corresponding cleaning device.

While an image is formed as above, one of the feeding rollers 20 may be selected at a proper timing. The feeding roller 20 may rotate and send out a recording medium, such as a sheet P, from a corresponding sheet cassette 21. The sheet P is conveyed along the sheet conveyance path 23 and stopped when its leading edge is sandwiched between the pair of registration rollers 24.

The registration rollers 24 may rotate and send the sheet P to a secondary transfer position synchronized with the full color image on the intermediated transfer member 15. At the secondary transfer position, the secondary transferer 25 may transfer the full color image onto the sheet P.

Next, the sheet P is sent upward along the sheet conveyance path 23 to the fixer 300. When the sheet P passes through the fixer 300, the full color image is fixed on the sheet P. The sheet P is ejected by the ejection rollers 26 and stacked on the stacker 27 above the image forming apparatus 100.

The toner bottle 28*c* may supply the cyan toner to the image developer 13*c*. Each of the toner bottles 28*m*, 28*y*, and 28*b* similarly supplies the magenta, yellow, or black toner to a corresponding image developer. After the secondary transfer, the secondary cleaning device 29 may clean and initialize the intermediate transfer member 15, for example, by removing any toner remaining thereon.

When images are recorded on both sides of the sheet P, the sheet P is sent to the double-side printing unit 92 by a switch claw (not shown) after the image (first image) is recorded on its first side and fixed by the fixer 300. In the double-side printing unit 92, the sheet P is reversed in the switchback path 93 and sent to the return path 94 so that a second side of the sheet P is turned up. On the intermediate transfer member 15, another image (second image) to be recorded on the second side is formed. The sheet P is sent to the secondary transferer 25 where the second image is transferred onto the second side of the sheet P. After passing through the fixer 300, the sheet P is stacked on the stacker 27 by the pair of ejection rollers 26.

Although an image forming method for a full color image is described above, a monochrome mode and a color mode may be selected. The image forming apparatus 100 may arbitrarily form a monochrome or color image by selectively using at least one of the image forming stations 10*c*, 10*m*, 10*y*, and 10*b* according to the selected mode.

The fixer 300 is described with reference to FIG. 5. The fixer 300 may include a fixing roller 30, a pressing roller 40, an induction coil 50, an inverter circuit 52, a control circuit 53, and a thermistor 54.

The fixing roller 30 includes a holder 32 and a fixing rotator 33 overlying the holder 32. The holder 32 and fixing rotator 33 may be unified to form a roller. The pressing roller 40 is a pressurizer and can be pressed to the fixing roller 30 to form a fixing nip n therebetween. The sheet P may pass the fixing nip n in a direction shown by arrow A in FIG. 5. The induction coil 50 may partly cover the fixing roller 30 from a side opposite to the pressing roller 40.

The pressing roller 40 may include a core metal 42 in its center and a rubber layer 43 overlying the core metal 42. The induction coil 50 may connect to the inverter circuit 52 to which the control circuit 53 may be connected. The thermistor 54 may detect a surface temperature of the fixing roller 30 and may input a detection result as a signal into the control circuit 53. The control circuit 53 may control the inverter circuit 52 based on the signal.

When the fixing roller 30 rotates, the pressing roller 40 may be driven to rotate. When electric current is applied to the induction coil 50, a magnetic field of high frequency waves may be induced. The magnetic field may cause an induction current in the fixing rotator 33 and a surface layer of the fixing roller 30 may be heated with joule heating. After warm-up of the fixer 300 is finished, image formation may be started. An image on the sheet P may be fixed when the sheet P passes through the fixing nip n.

Figure 6A:
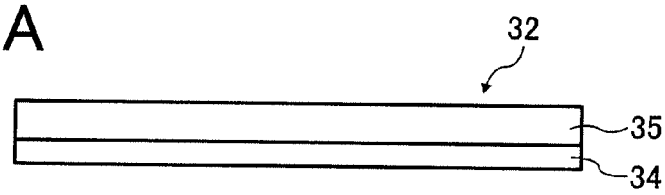
FIG. 6A illustrates a layer structure of a holder of a fixing roller included in the fixer of FIG. 5.
Figure 6B:
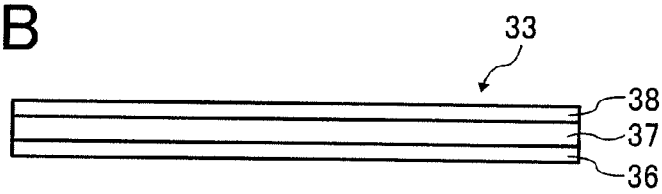
FIG. 6B illustrates an example layer structure of a fixing rotator included in the fixer of FIG. 5.
Figure 6C:
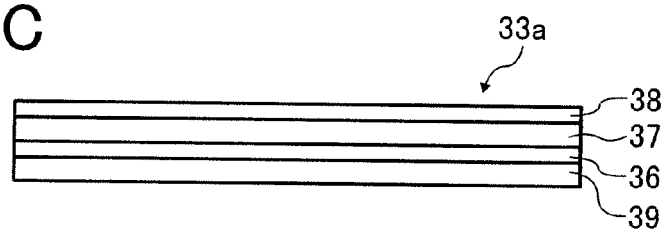
FIG. 6C illustrates another example layer structure of the fixing rotator included in the fixer of FIG. 5.

Referring to FIGS. 6A, 6B, and 6C, the holder 32 and fixing rotator 33 of the fixing roller 30 are described. FIG. 6A illustrates layers in the holder 32. The holder 32 may include a core metal 34 and at least one elastic insulating layer 35 around the core metal 34. In an exemplary embodiment, an elastic layer and an insulating layer are integrated in the elastic insulating layer 35. Alternatively, the elastic insulating layer 35 may separately include an elastic layer and an insulating layer. The elastic insulating layer 35 may include a foam, for example, an aerated silicone, and/or an elastic rubber. By including the above material, the elastic insulating layer 35 may have desirable rigidity to form a fixing nip having a desirable width. Further, the elastic insulating layer 35 may have an insulating function, which may decrease heat capacity and start-up time of fixing.

FIG. 6B illustrates layers in the fixing rotator 33. The fixing rotator 33 may include an induction heating layer 36 as a heating layer, an elastic body layer 37, and a release layer 38. The elastic body layer 37 may be provided on an outer surface of the induction heating layer 36. The release layer 38 may be formed on the elastic body layer 37. The induction heating layer 36 may include a metal. Volume resistivity of the metal may be not greater than $3.0\times10^{-8}$ Ωm, which may further decrease thickness of the induction heating layer 36 at which an eddy-current load of the fixing rotator 33 is optimum. Examples of the metal include silver, copper, and aluminum. Further, copper plating may be desirable.

As a result, the heat capacity of the fixing rotator 33 may be decreased and heating may be effectively performed. A desirable thickness of the induction heating layer 36 may be not greater than 100 μm.

The elastic body layer 37 may have a thickness of 1 mm or less. The pressing roller 40 may be uniformly in contact with the release layer 38 of the fixing rotator 33 at the fixing nip n. Therefore, a decrease in heat conductivity may be prevented or reduced and uneven brightness of the transferred image on the sheet P may be prevented or reduced.

FIG. 6C illustrates a fixing rotator 33*a* including a substrate 39 on its inner side as an exemplary embodiment. The substrate 39 may include a nonmagnetic stainless steel layer or a polyimide layer. The induction heating layer 36, the elastic body layer 37, and the release layer 38 may be formed on the substrate 39 in order. A desirable thickness of the substrate 39 plus the induction heating layer 36 may be not greater than 100 μm, so that flexural rigidity of the fixing rotator 33*a* is not excessively high. At this thickness, the fixing nip n may be effectively formed.

The holder 32 having the elastic insulating layer 35 and the fixing rotator 33 having the induction heating member 36 may be separately formed. The fixing rotator 33 may be provided on the outer surface of the holder 32 and may be wholly or partially bonded to the holder 32 to form an integrated roller. When the fixing roller 30 is manufactured as above, the fixing rotator 33 may not move to one side in its width direction on the holder 32 while rotating, as described later. Therefore, damage to both edges of the fixing rotator 33 in the width direction may be prevented or reduced.

Figure 7:
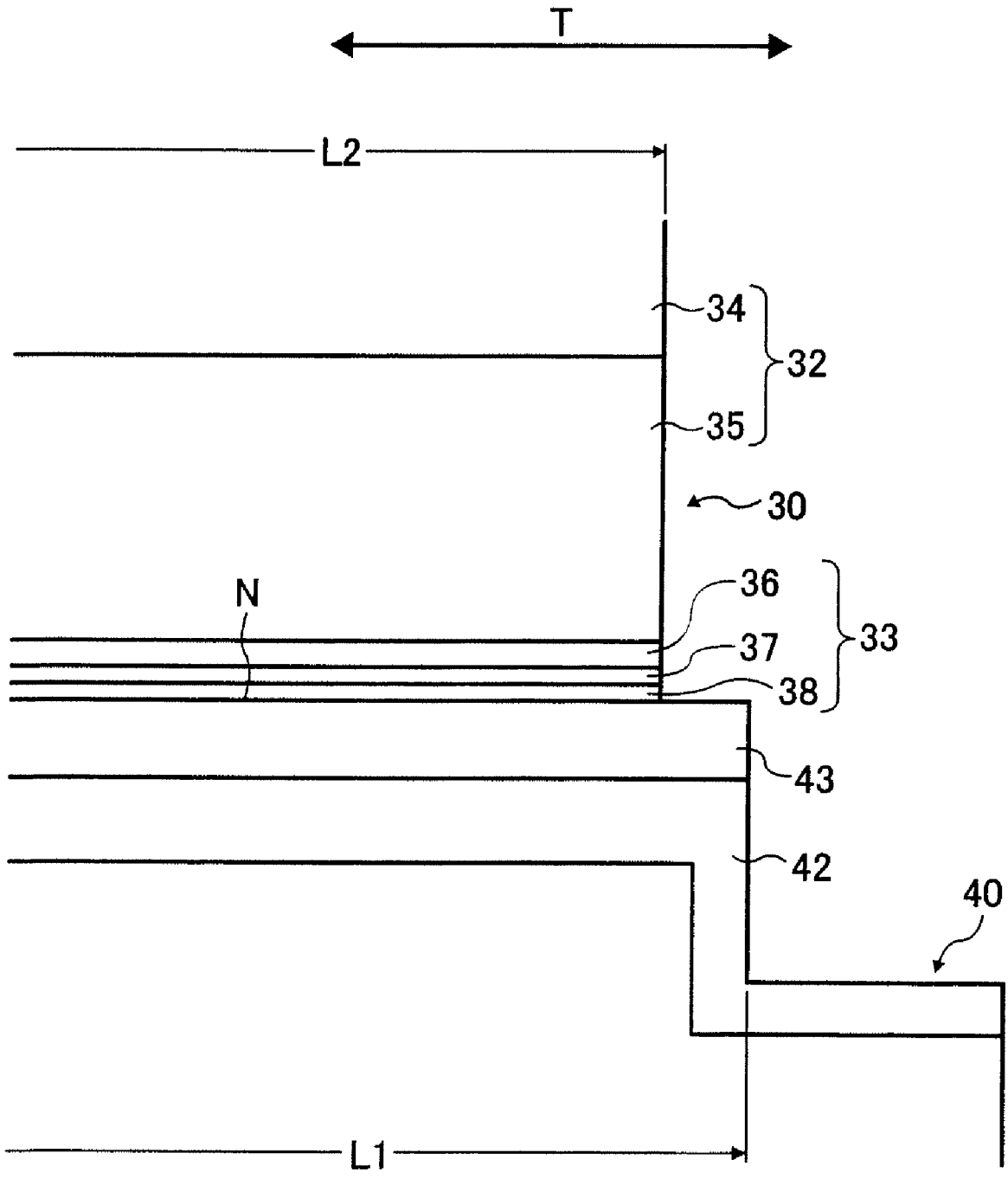
FIG. 7 is an illustration of edges of the fixing roller and a pressing roller in the fixer of FIG. 5.

FIG. 7 illustrates the edges of the fixing roller 30 and the pressing roller 40 in their width direction shown as arrow T (axis direction). The width direction is perpendicular to the sheet conveyance direction.

In FIG. 7, a length of the pressing roller 40 at the fixing nip N in the width direction is shown as length L1. A Length of the elastic insulating layer 35 and the induction heating layer 36 is shown as length L2. In an exemplary embodiment, the length L1 may be longer than the length L2 as in FIG. 7. When the pressing roller 40 is pressed to the holder 32 via the fixing rotator 33, elastic repulsion is likely to occur in the elastic insulating layer 35. The elastic repulsion in an entire width of the induction heating layer 36 may be received by the pressing roller 40. The length L1 may be substantially equal to the length L2, although the length L1 is longer than the length L2 in FIG. 7.

When electric current is applied to the induction coil 50 and the magnetic field is induced (FIG. 5), the induction current is induced at an induction coil 50 side of the induction heating layer 36 in the fixing rotator 33. Accordingly, a surface layer of the fixing roller 30 may be heated with joule heating.

As the metal is included in the induction heating layer 36, the thickness of the induction heating layer 36 at which an eddy-current load of the fixing rotator 33 is optimum may be decreased and the heat capacity of the fixing rotator 33 may be decreased. Further, enough of a fixing nip N may be formed and less shearing force may occur in the induction heating layer 36, which may prevent or reduce damage of both edges of the fixing rotator 33 in the width direction shown as arrow T.

Figure 8:
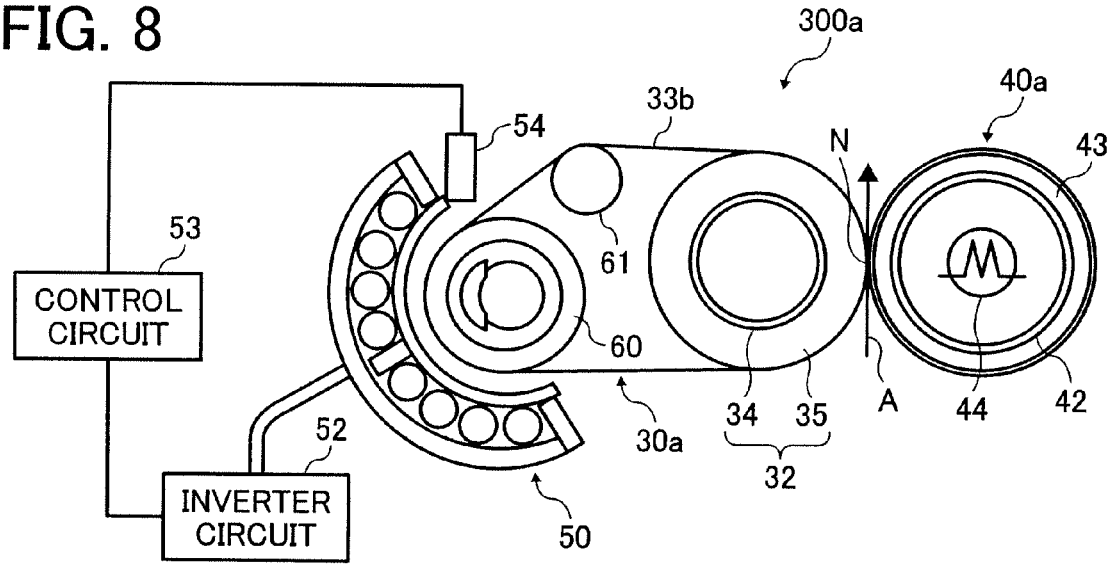
FIG. 8 is illustration of a fixer according to another exemplary embodiment.

FIG. 8 illustrates a fixer 300*a* as an exemplary embodiment to be installed in the image forming apparatus 100. The fixer 300*a* may include a fixing part 30*a*, a pressing roller 40*a*, an induction coil 50, an inverter circuit 52, a control circuit 53, and a thermistor 54. The fixing part 30*a* may include a roller-shaped holder 32, a fixing rotator 33*b*, a sleeve-shaped roller 60, and a tension roller 61. The fixing rotator 33*b* may be a flexible endless belt. The holder 32 and the fixing rotator 33*b* may be separately formed. The holder 32, the roller 60, and the tension roller 61 may serve as a plurality of supporters around which the fixing rotator 33*b* is stretched. The tension roller 61 may press the fixing rotator 33*b* from its inner surface so that the fixing rotator 33*b* is in tension.

Figure 5:
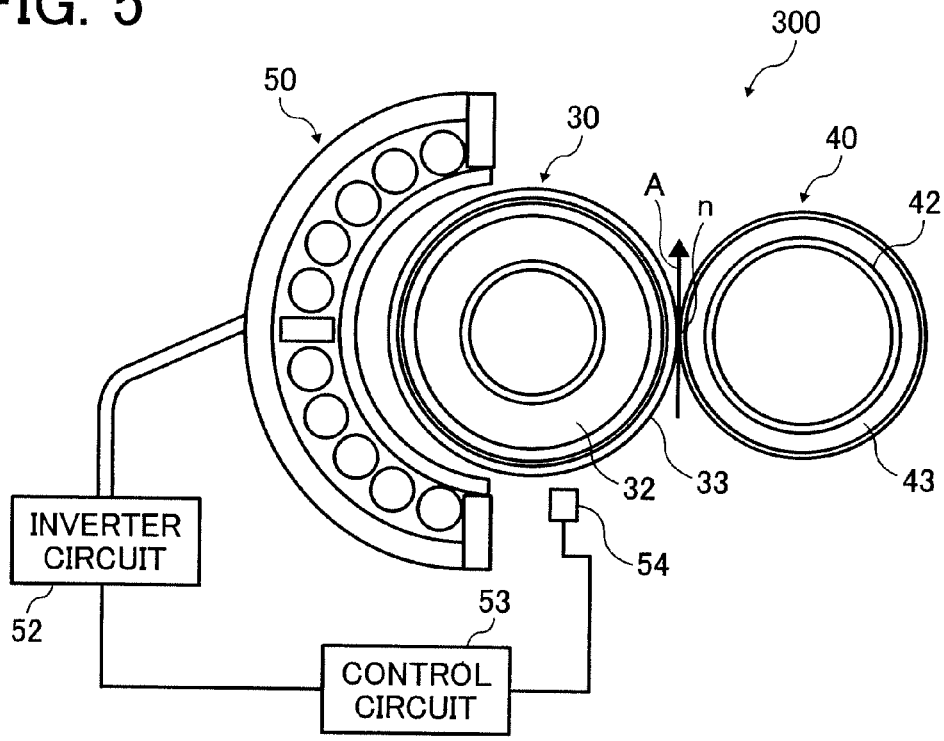
FIG. 5 is a schematic view illustrating a cross-section of an exemplary embodiment of a fixer included in the image forming apparatus of FIG. 4.

The holder 32 may include a core metal 34 and an elastic insulating layer 35 wound around the core metal 34, similarly to the fixing roller 30 illustrated in FIG. 5. The pressing roller 40*a* may be pressed to the holder 32 via the fixing rotator 33*b* to form a fixing nip N between the pressing roller 40*a* and the fixing rotator 33*b*. The sheet P may pass the fixing nip N in a direction shown arrow A. The induction coil 50 may cover about a half of the roller 60 via the fixing rotator 33*b*. The induction coil 50 may connect to the inverter circuit 52 to which the control circuit 53 may be connected. The thermistor 54 may send a signal to the control circuit 53.

The pressing roller 40*a* may include a core metal 42 and a rubber layer 43 around the core metal 42 similarly to the pressing roller 40 illustrated in FIG. 5. The pressing roller 40*a* may further include a heater 44 therein. With the heater 44, the start-up time of fixing may be shortened. Since power consumption may be increased due to the heater 44, the heater 44 may not be necessary when power-saving is emphasized.

When the holder 32 rotates and the roller 60 and the tension roller 61 are driven to rotate, the fixing rotator 33*b* may be rotated. The pressing roller 40*a* may be similarly driven to rotate. When electric current is applied to the induction coil 50, a magnetic field of high frequency waves may be induced. The magnetic field may cause induction current in the fixing rotator 33*b*. Accordingly, a surface layer of the fixing rotator 33*b* may be heated with joule heating. After warm-up of the fixer 300*a* is finished, image formation may be started. An image on the sheet P may be fixed when the sheet P passes through the fixing nip N.

Figure 9:
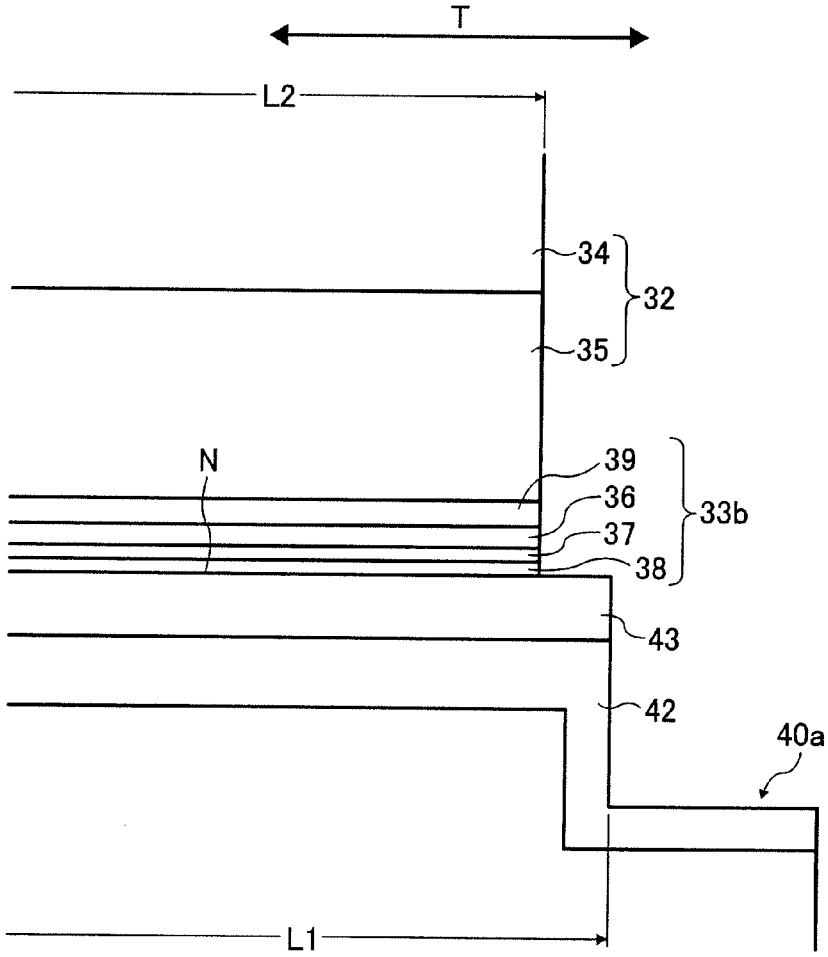
FIG. 9 is an illustration of edges of a holder, a fixing rotator, and a pressing roller included in the fixer of FIG. 8.

FIG. 9 illustrates edges of the holder 32, the fixing rotator 33*b*, and the pressing roller 40*a* in their width direction (axis direction) shown as arrow T. The width direction is perpendicular to the sheet conveyance direction.

As illustrated in FIG. 9, the fixing rotator 33*b* may include a substrate 39 on its inner side. On the substrate 39, an induction heating layer 36, an elastic body layer 37, and a release layer 38 may be formed in order, similarly to the fixing rotator 33*a* of FIG. 6C. For example, the substrate 39 may include a nonmagnetic stainless steel layer having a higher modulus of direct elasticity (Young's modulus) and may have a thickness of 100 μm or less. Alternatively, the substrate 39 may include a polyimide having a thickness of 300 μm or less. With the substrate 39 described above, flexural rigidity of the fixing rotator 33*b* may be increased within a desirable range. Further, durability of the fixing rotator 33*b* against cyclic stress at the fixing nip N may be enhanced.

In FIG. 9, a length of the pressing roller 40*a* at the fixing nip N in the direction of arrow T is shown as length L1. A length of the elastic insulating layer 35 and the induction heating layer 36 is shown as length L2. In an exemplary embodiment, the length L1 may be longer than the length L2. When the pressing roller 40*a* is pressed to the holder 32 via the fixing rotator 33*b*, elastic repulsion is likely to occur in the elastic insulating layer 35. The pressing roller 40*a* may receive the elastic repulsion in an entire width of the induction heating layer 36. The length L1 may be substantially equal to the length L2, although the length L1 is longer than the length L2 in FIG. 9.

When electric current is applied to the induction coil 50 and a magnetic field is induced (FIG. 8), the induction current is induced at an induction coil 50 side of the induction heating layer 36 in the fixing rotator 33*b* and a surface layer of the fixing rotator 33*b* may be heated with joule heating.

As the metal is included in the induction heating layer 36, the thickness of the induction heating layer 36 at which an eddy-current load of the fixing rotator 33*b* is optimum may be decreased and the heat capacity of the fixing rotator 33*b* may be decreased. Further, enough of a fixing nip N may be formed and less shearing force may occur in the induction heating layer 36, which may prevent or reduce damage to both edges of the fixing rotator 33*b* in the width direction (arrow T in FIG. 9).

The supporters (e.g. the holder 32, the roller 60, and the tension roller 61) around which the fixing rotator 33*b* is stretched are rollers in FIG. 8, as an exemplary embodiment. The supporters may be rollers, pads, or a combination thereof. Although the rotation of the holder 32 may cause the fixing rotator 33*b* to rotate, another roller-shaped member around which the fixing rotator 33*b* is stretched may cause the fixing rotator 33*b* to rotate. Alternatively, the pressing roller 40*a* may cause the fixing rotator 33*b* to rotate. Instead of the pressing roller 40*a*, a pad-shaped pressurizer may be used.

Figure 10:
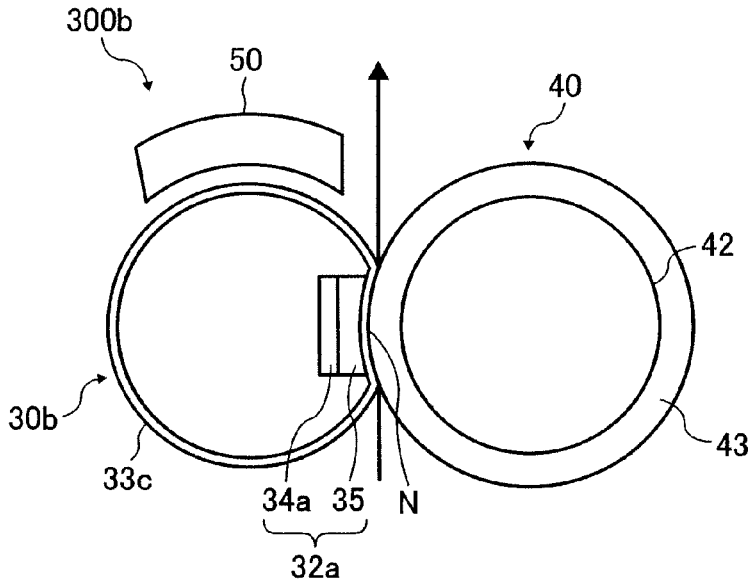
FIG. 10 is an illustration of a fixer according to another exemplary embodiment.

FIG. 10 illustrates a fixer 300*b* as an exemplary embodiment. The fixer 300*b* may include a fixing part 30*b*, a pressing roller 40, and an induction coil 50. The fixing part 30*b* may include a holder 32*a* and a fixing rotator 33*c* that are separately formed. The holder 32*a* may be a pad. The fixing rotator 33*c* may be a flexible, endless sleeve. The fixing rotator 33*c* may be stretched around the holder 32*a*. The holder 32*a* may include a substrate 34*a* and an elastic insulating layer 35 on the substrate 34*a*.

The pressing roller 40 may be pressed to the holder 32*a* via the fixing rotator 33*c* to form a fixing nip N between the pressing roller 40 and the fixing rotator 33*c*. The sheet P may pass the fixing nip N in a direction shown an arrow in FIG. 10. The induction coil 50 may cover a part of the fixing rotator 33*c*. The pressing roller 40 may include a core metal 42 and a rubber layer 43 around the core metal 42.

Although not shown, the induction coil 50 may connect to an inverter circuit to which a control circuit may be connected, similarly to the fixer 300 in FIG. 5. Similarly, a thermistor may send a signal to the control circuit.

When the pressing roller 40 rotates, the fixing rotator 33*c* may be rotated. When electric current is applied to the induction coil 50, a magnetic field of high frequency waves may be induced. The magnetic field may cause an induction current in the fixing rotator 33*c*. Accordingly, a surface layer of the fixing rotator 33*c* may be heated with joule heating. After warm-up of the fixer 300*b* is finished, image formation may be started. An image on the sheet P may be fixed when the sheet P passes through the fixing nip N.

Figure 11:
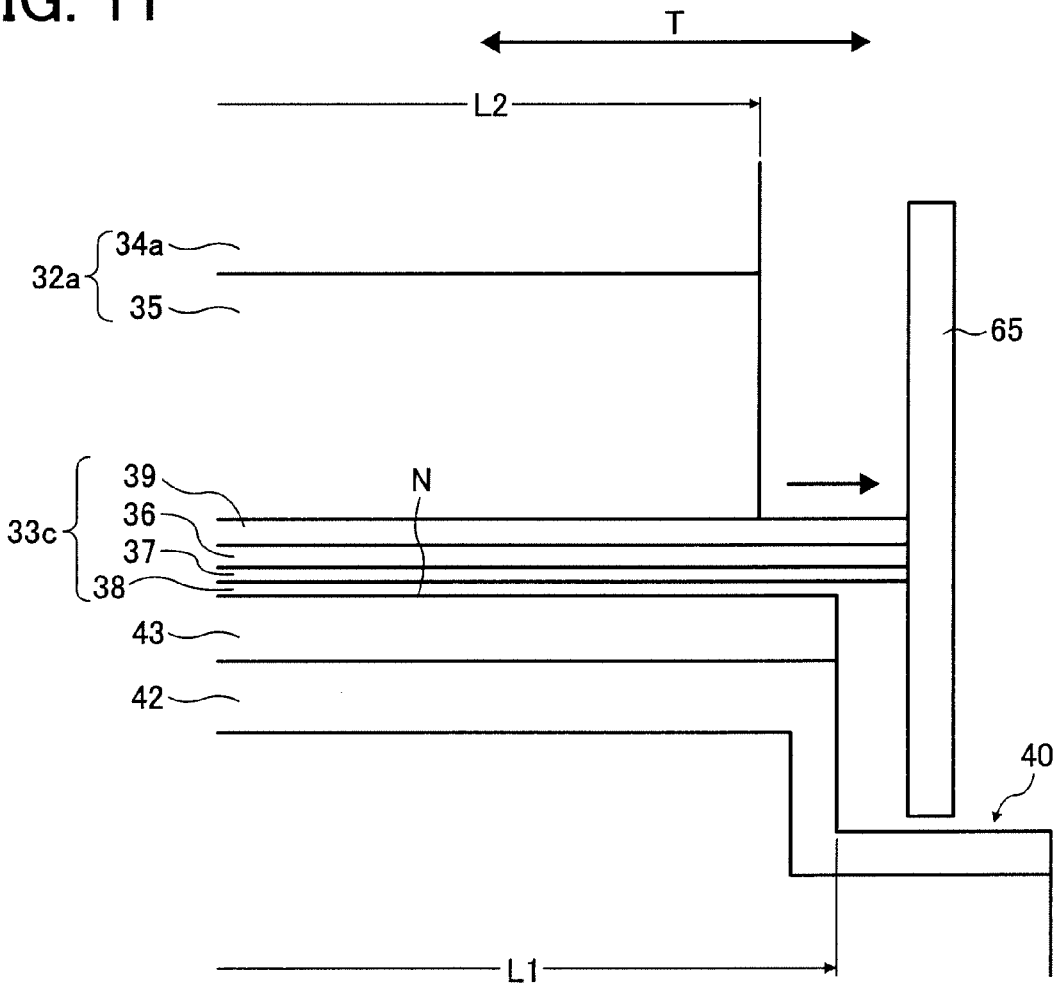
FIG. 11 is an illustration of edges of a holder, a fixing rotator, and a pressing roller in the fixer of FIG. 10.

FIG. 11 illustrates edges of the holder 32*a*, the fixing rotator 33*c*, and the pressing roller 40 in their width direction (axis direction) shown as arrow T. The width direction is perpendicular to the sheet conveyance direction. The fixer 300*b* may further include a pair of side plates 65 to cover the edges of the holder 32*a*, the fixing rotator 33*c*, and the pressing roller 40 in their width direction.

As illustrated in FIG. 11, The sleeve-shaped fixing rotator 33*c* may include a substrate 39, an induction heating layer 36, an elastic body layer 37, and a release layer 38, similarly to the fixing rotator 33*a* of FIG. 6C. For example, the substrate 39 may include a nonmagnetic stainless steel layer having a higher modulus of direct elasticity and may have a thickness of 100 μm or less. Alternatively, the substrate 39 may include a polyimide having a thickness of 300 μm or less. It is desirable to include a low friction material, for example, oil or grease, between the holder 32*a* and the fixing rotator 33*c*.

In the fixer 300*b*, a length of the pressing roller 40 at the fixing nip N in the direction of arrow T is shown as length L1. Although FIG. 11 illustrates a state in which the fixing rotator 33*c* rotates to one side and the edge thereof protrudes from an edge of the holder 32*a* in the direction shown as arrow T, the induction heating layer 36 has a similar length to a length of the elastic insulating layer 35 shown as length L2.

In an exemplary embodiment, the length L1 may be substantially equal to or longer than the length L2. When the pressing roller 40 is pressed to the holder 32*a* via the fixing rotator 33*c*, elastic repulsion is likely to occur in the elastic insulating layer 35. The pressing roller 40 may receive the elastic repulsion of the induction heating layer 36 in an entire width of the induction heating layer 36.

When electric current is applied to the induction coil 50 and a magnetic field is induced (FIG. 10), the induction current is induced at an induction coil 50 side of the induction heating layer 36 in the fixing rotator 33*c* and a surface layer of the fixing rotator 33*c* may be heated with joule heating.

As metal is included in the induction heating layer 36, the thickness of the induction heating layer 36 at which an eddy-current load of the fixing rotator 33*c* is optimum may be decreased and the heat capacity of the fixing rotator 33*c* may be decreased. Further, enough of a fixing nip N may be formed and less shearing force may occur in the induction heating layer 36. Accordingly, mechanical strength of the edges of the fixing rotator 33*c* in the width direction (arrow T) may be enhanced, which may prevent or reduce damage to both edges of the fixing rotator 33*c* in the width direction.

In the above embodiment, when the pressing roller 40 that is a pressurizer rotates, the fixing rotator 33*c* stretched around the holder 32*a* is rotated. Alternatively, the holder 32*a* may be roller-shaped and fixing rotator 33*c* may be rotated by rotation of the holder 32*a*. When the holder 32*a* is roller-shaped, the shape of the pressurizer may be a pad, and is not limited to a roller.

When the fixing rotator is an endless belt, as illustrated in FIG. 8, or a sleeve, as illustrated in FIG. 10, and is stretched around the holder that is formed separately from the fixing rotator, the fixing rotator may move to one side in the width direction on the holder while rotating.

Figure 12:
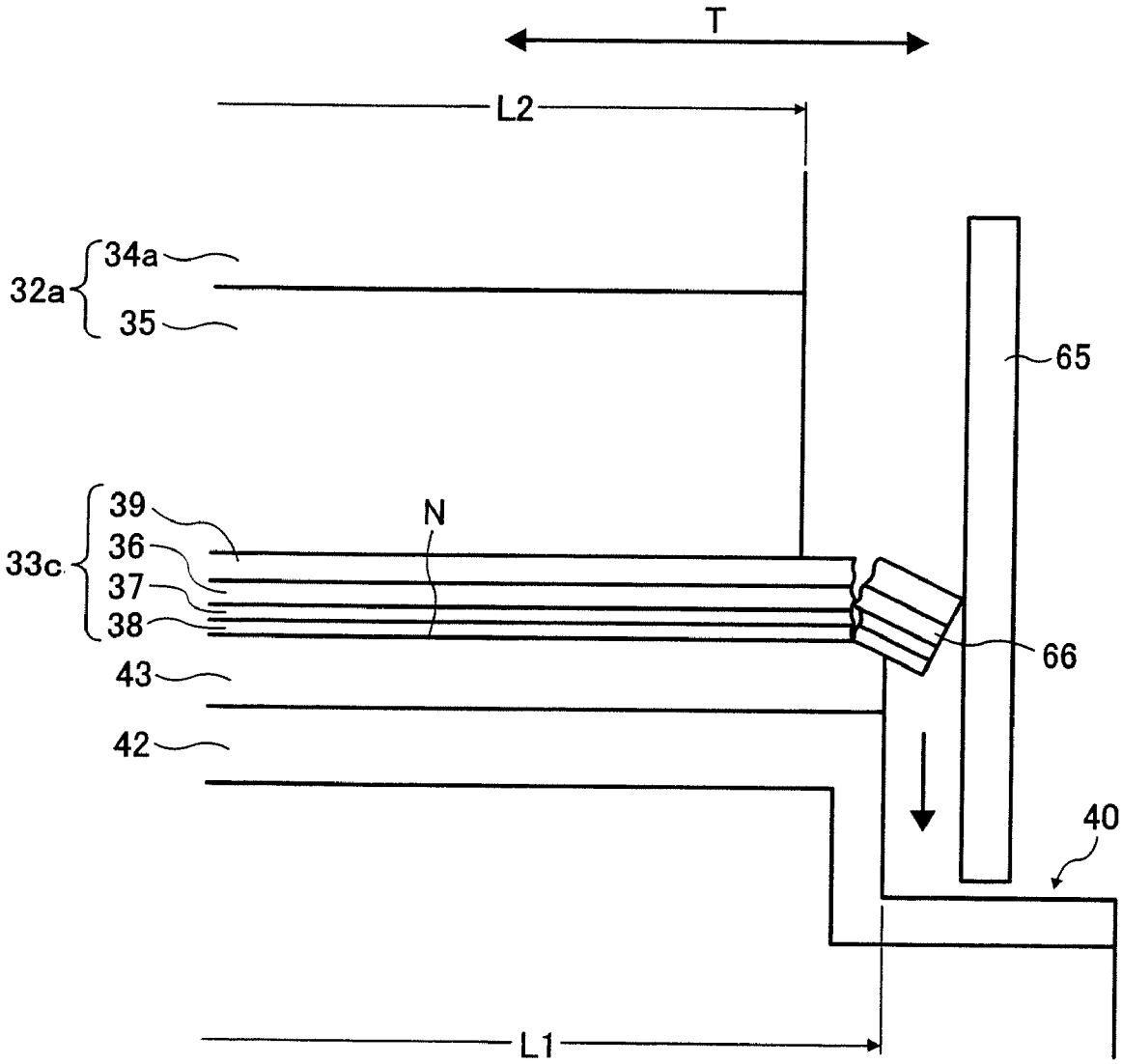
FIG. 12 illustrates a state in which the edge of the fixing rotator hits the sidewall and is broken in the fixer of FIG. 10.

If the fixing rotator 33*c* rotating to one side in the width direction (arrow T) hits the sidewall 65 as in FIG. 11, an edge thereof may be damaged. FIG. 12 illustrates a state in which the fixing rotator 33*c* hits the sidewall 65 and an edge 66 of the fixing rotator 33*c* is broken.

Figure 13:
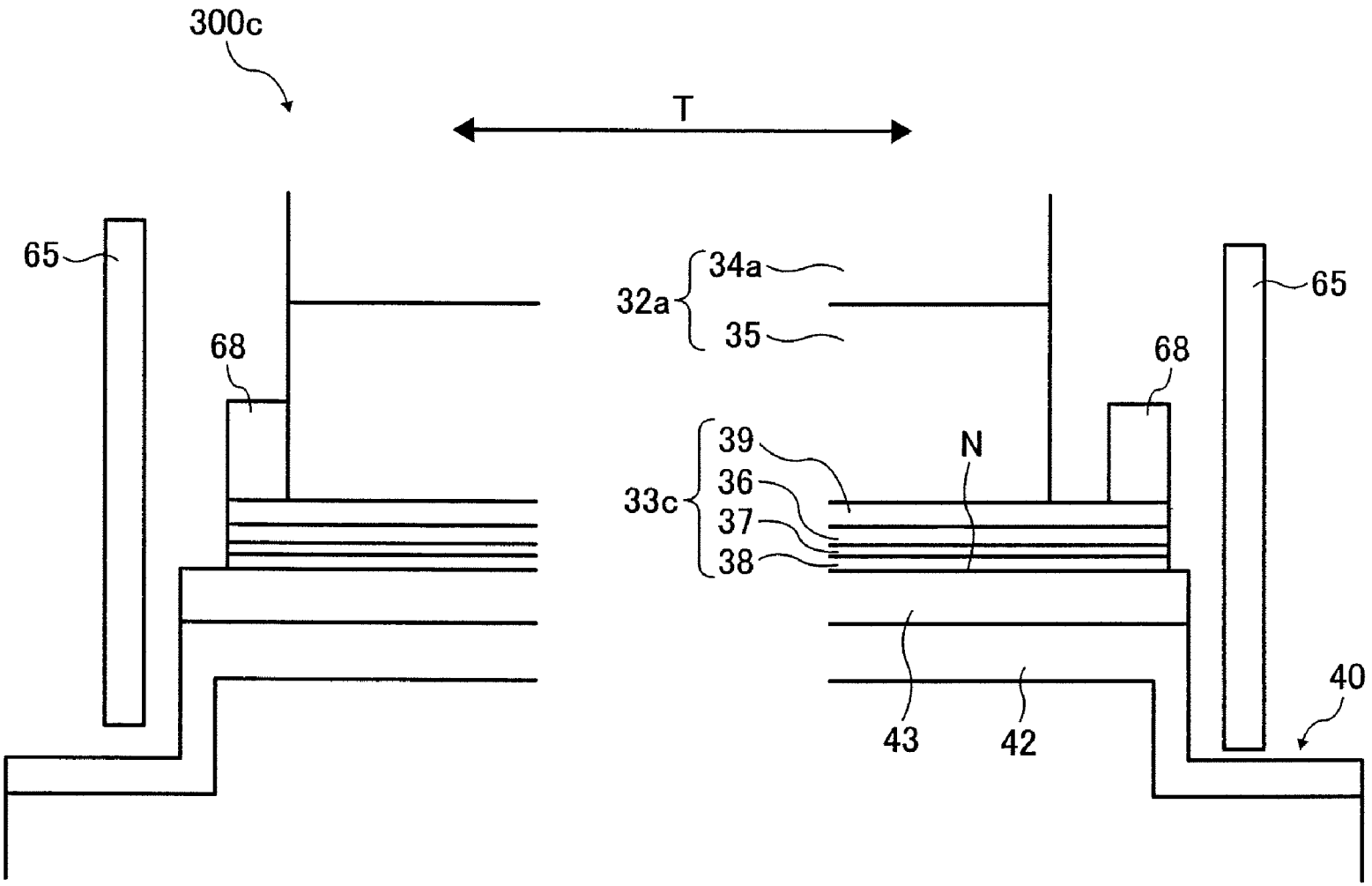
FIG. 13 is a partial illustration of a fixer according to another exemplary embodiment.

FIG. 13 illustrates a fixer 300*c* as an exemplary embodiment. The fixer 300*c* may include a holder 32*a*, a fixing rotator 33*c*, a pressing roller 40, and a pair of sidewalls 65. The fixer 300*c* may have a similar structure to the fixer 300*b* illustrated in FIGS. 10 and 11, except for a pair of stoppers 68 provided on the edges of the fixing rotator 33*c*. The fixing rotator 33*c* may be an endless, flexible material and may be stretched around the holder 32*a* that may be a pad or a roller. As shown in FIG. 13, a length of the holder 32*a* may be shorter than a length of the fixing rotator 33*c* in the direction of arrow T to make space to attach the stoppers 68 on both edges of the fixing rotator 33*c*.

The stoppers 68 may include a high-temperature resin. When the fixing rotator 33*c* moves to one side in the direction of arrow T on the holder 32*a* while rotating, one of the stoppers 68 contacts an edge surface of the holder 32*a*. The stopper 68 may prevent the fixing rotator 33*c* from moving further to the side and hitting the sidewall 65. Therefore, the damage on the edges of the fixing rotator 33*c* may be prevented.

This application claims priority and contains subject matter related to Japanese Patent Applications No. JP2006-067386 filed on Mar. 13, 2006 and No. JP2006-283310 filed on Oct. 18, 2006 in the Japan Patent Office, respectively, the entire contents of each of which are hereby incorporated by reference.

Having now fully described exemplary embodiments of the invention, it will be apparent to one of ordinary skill in the art that many changes and modifications can be made thereto without departing from the spirit and scope of the invention as set forth therein.

What is claimed is:

1. A fixer configured to fix an image on a recording medium passing through a fixing nip, the fixer comprising:

a holder including an elastic layer;

a fixing rotator including a heating layer, provided overlying the holder; and a pressurizer configured to pressurize the holder via the fixing rotator to form the fixing nip, wherein a part of the pressurizer, which forms the fixing nip, has a length in a width direction perpendicular to a conveyance direction of the recording medium not less than a length of the heating layer in the width direction perpendicular to the conveyance direction of the recording medium.

2. The fixer of claim 1, wherein the heating layer includes a metal having a volume resistivity not greater than $3.0\times10^{-8}$ Ωm.

3. The fixer of claim 1, wherein the heating layer has a thickness not greater than 100 μm.

4. The fixer of claim 1, wherein the fixing rotator further includes a substrate, and the heating layer is formed on the substrate.

5. The fixer of claim 4, wherein the heating layer has a thickness not greater than 100 μm including the substrate.

6. The fixer of claim 4, wherein the substrate includes a nonmagnetic stainless steel and has a thickness not greater than 100 μm.

7. The fixer of claim 4, wherein the substrate includes a polyimide and has a thickness not greater than 300 μm.

8. The fixer of claim 1, wherein the elastic layer includes a foam.

9. The fixer of claim 1, wherein the elastic layer includes an elastic rubber.

10. The fixer of claim 1, wherein the fixing rotator further comprises:

an elastic body layer located overlying the heating layer and having a thickness not greater than 1 mm; and a release layer located overlying the elastic body layer.

11. The fixer of claim 1, wherein the holder and the fixing rotator are unified in a shape of a roller to form a fixing roller.

12. The fixer of claim 1, wherein the fixing rotator is bonded to the holder.

13. The fixer of claim 1, wherein the holder is a roller or a pad, and the fixing rotator is formed of an endless flexible material stretched around the holder.

14. The fixer of claim 13, further comprising:

a plurality of supporters, wherein the fixing rotator has a shape of an endless belt stretched around the plurality of supporters including the holder.

15. The fixer of claim 14, wherein the supporters are rollers, pads, or a combination thereof.

16. The fixer of claim 13, wherein the fixing rotator has a shape of an endless sleeve stretched around the holder.

17. The fixer of claim 13, further comprising:

a low friction material located between the fixing rotator and the holder, wherein the fixing rotator is configured to rotate by rotation of the pressurizer.

18. The fixer of claim 13, further comprising:

a pair of stoppers on both edges of the fixing rotator in the width direction, wherein each of the stoppers is configured to prevent the fixing rotator from rotating to one side while contacting an edge surface of the holder.

19. The fixer of claim 1, wherein the length of the part of the pressurizer in the width direction is greater than the length of the heating layer in the width direction.

20. An image forming apparatus, comprising:

a photoreceptor;

a charger configured to charge the photoreceptor;

an irradiator configured to irradiate the photoreceptor to form an electrostatic latent image thereon;

an image developer configured to develop the electrostatic latent image with a toner to form a toner image;

a transferer configured to transfer the toner image onto a recording medium; and a fixer configured to fix the toner image on the recording medium passing through a fixing nip, the fixer comprising:

a holder including an elastic layer, a fixing rotator including a heating layer, provided overlying the holder, and a pressurizer configured to pressurize the holder via the fixing rotator to form the fixing nip, wherein a part of the pressurizer, which forms the fixing nip, has a length in a width direction perpendicular to a conveyance direction of the recording medium not less than a length of the heating layer in the width direction perpendicular to the conveyance direction of the recording medium.

21. A fixer configured to fix an image on a recording medium passing through a fixing nip, the fixer comprising:

a fixing belt including a heating layer;

a pad provided inside a fixing rotator; and a pressure roller configured to pressurize the pad via the fixing rotator to form the fixing nip, wherein the pressure roller has a length in a width direction perpendicular to a conveyance direction of the recording medium not less than a length of the heating layer in the width direction perpendicular to the conveyance direction of the recording medium.

* * * * *